US009145886B2

(12) United States Patent
Ferguson et al.

(10) Patent No.: US 9,145,886 B2
(45) Date of Patent: Sep. 29, 2015

(54) ELECTRIC VACUUM PUMP BACKUP CONTROL SYSTEM AND METHOD

(75) Inventors: Russ William Ferguson, Ypsilanti, MI (US); Daniel A. Gabor, Canton, MI (US); Gunnar Robert Ross, Livonia, MI (US); John Phillip McCormick, Milford, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 298 days.

(21) Appl. No.: 13/048,234

(22) Filed: Mar. 15, 2011

(65) Prior Publication Data

US 2012/0237360 A1 Sep. 20, 2012

(51) Int. Cl.
*B60T 13/46* (2006.01)
*F04B 49/06* (2006.01)

(52) U.S. Cl.
CPC ..... *F04B 49/06* (2013.01)

(58) Field of Classification Search
CPC ..... B60T 13/46; B60T 13/52; F04B 49/06
USPC ..... 303/12, 122, 122.1, 122.05, 122.08, 303/122.09, 122.11, 122.12, 122.15, 114.3
See application file for complete search history.

(56) References Cited

U.S. PATENT DOCUMENTS

| | | | | |
|---|---|---|---|---|
| 5,881,557 | A | 3/1999 | Shields | |
| 5,961,189 | A * | 10/1999 | Lutteke et al. | 303/114.3 |
| 6,410,993 | B1 * | 6/2002 | Giers | 303/20 |
| 6,598,943 | B2 * | 7/2003 | Harris | 303/122.09 |
| 2008/0150351 | A1 | 6/2008 | Ruffer et al. | |
| 2008/0164753 | A1 | 7/2008 | Crombez et al. | |
| 2009/0045672 | A1 * | 2/2009 | Nishino et al. | 303/113.3 |
| 2009/0236903 | A1 | 9/2009 | Nishino et al. | |
| 2012/0253574 | A1 * | 10/2012 | Krueger et al. | 701/22 |

* cited by examiner

*Primary Examiner* — Thomas J Williams
(74) *Attorney, Agent, or Firm* — David Kelley, Esq.; Tung & Associates

(57) ABSTRACT

An electric vacuum pump backup control system includes a brake on/off switch, a primary electric vacuum pump control interfacing with the brake on/off switch, a secondary electric vacuum pump control interfacing with the brake on/off switch and the primary electric vacuum pump control and an electric vacuum pump interfacing with the primary electric vacuum pump control.

17 Claims, 3 Drawing Sheets

ELECTRIC VACUUM PUMP BACKUP CONTROL SYSTEM AND METHOD

FIELD

The disclosure generally relates to vehicle braking systems. More particularly, the disclosure relates to an electric vacuum pump backup control system and method which controls a brake system vacuum booster in the event that a primary electric vacuum pump (EVP) is disabled.

BACKGROUND

The braking system of modern vehicles may include an electronic control unit (ECU) which controls an electric vacuum pump (EVP) that provides vacuum pressure to a brake system vacuum booster for braking. In the event that the ECU is compromised, the EVP may become disabled. Consequently, the brake system vacuum booster may become incapable of providing boost for braking, in which case braking of the vehicle may require additional effort on the part of the driver.

Accordingly, an electric vacuum pump backup control system and method which controls a brake system vacuum booster in the event that a primary electric vacuum pump (EVP) is disabled is needed.

SUMMARY

The disclosure is generally directed to an electric vacuum pump backup control system. An illustrative embodiment of the system includes a brake on/off switch, a primary electric vacuum pump control interfacing with the brake on/off switch, a secondary electric vacuum pump control interfacing with the brake on/off switch and the primary electric vacuum pump control and an electric vacuum pump interfacing with the primary electric vacuum pump control.

In some embodiments, the electric vacuum pump backup control system may include a brake on/off switch; a primary electric vacuum pump control interfacing with the brake on/off switch; a secondary electric vacuum pump control interfacing with the brake on/off switch and the primary electric vacuum pump control and an electric vacuum pump interfacing with the primary electric vacuum pump control. The secondary electric vacuum pump control is adapted to operate the electric vacuum pump responsive to loss of communication with the primary electric vacuum pump control and responsive to receiving a request for activation from the primary electric vacuum pump control. The primary electric vacuum pump control is adapted to resume operation of the electric vacuum pump responsive to restoration of communication between the primary electric vacuum pump control and the secondary electric vacuum pump control and responsive to receiving a request for deactivation from the secondary electric vacuum pump control.

The disclosure is further generally directed to an electric vacuum pump backup control method. An illustrative embodiment of the method includes operating an electric vacuum pump using a primary electric vacuum pump control and operating the electric vacuum pump using a secondary electric vacuum pump control upon deactivation of the primary electric vacuum pump control.

BRIEF DESCRIPTION OF THE DRAWINGS

The disclosure will now be made, by way of example, with reference to the accompanying drawings, in which.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
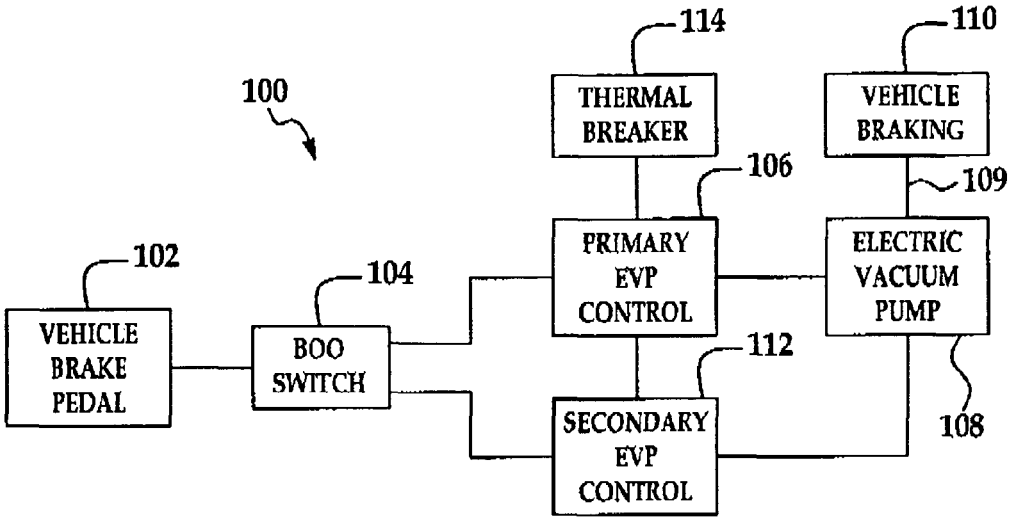
FIG. 1 is a block diagram of an illustrative embodiment of the electric vacuum pump backup control system.

Referring initially to FIG. 1, an illustrative embodiment of the electric vacuum pump backup control system, hereinafter system, is generally indicated by reference numeral 100. The system 100 may include a vehicle brake pedal 102. A brake on/off (BOO) switch 104 may interface with the vehicle brake pedal 102. A primary EVP (electric vacuum pump) control 106 may interface with the BOO switch 104. In some embodiments, the primary EVP control 106 may be a vehicle Brake Control Module (BCM). An electric vacuum pump (EVP) 108 may interface with the primary EVP control 106. The EVP 108 may be adapted to provide vacuum pressure through vehicle brake lines 109 to vehicle brakes 110 for operation of the vehicle brakes 110 in the conventional manner. A secondary EVP control 112 may interface with the BOO switch 104 and the primary EVP control 106. The EVP 108 may interface with the secondary EVP control 112. In some embodiments, a thermal breaker 114 may interface with the primary EVP control 101 to limit the run time of the primary EVP control 101.

Under normal braking conditions during operation of the vehicle, the vehicle brake pedal 102 is depressed by an operator of the vehicle. The depressed vehicle brake pedal 102 closes the BOO switch 104. The BOO switch 104 actuates the primary EVP control 106, which enters a vacuum pump control state. In the vacuum pump control state, the primary EVP control 106 operates the EVP 108. The EVP 108 generates vacuum (boost) pressure and provides the vacuum pressure to the vehicle brakes 110 through the vehicle brake lines 109. The vehicle brakes 110 slow or stop the vehicle typically depending on the duration and magnitude of foot pressure which the vehicle operator applies to the vehicle brake pedal 102.

Under braking conditions in which the primary EVP control 106 is disabled, the BOO switch 104 actuates the secondary EVP control 112. The secondary EVP control 112 enters a vacuum pump control state and operates the EVP 108. The EVP 108 generates vacuum (boost) pressure and provides the vacuum pressure to the vehicle brakes 110 through the vehicle brake lines 109.

Figure 2:
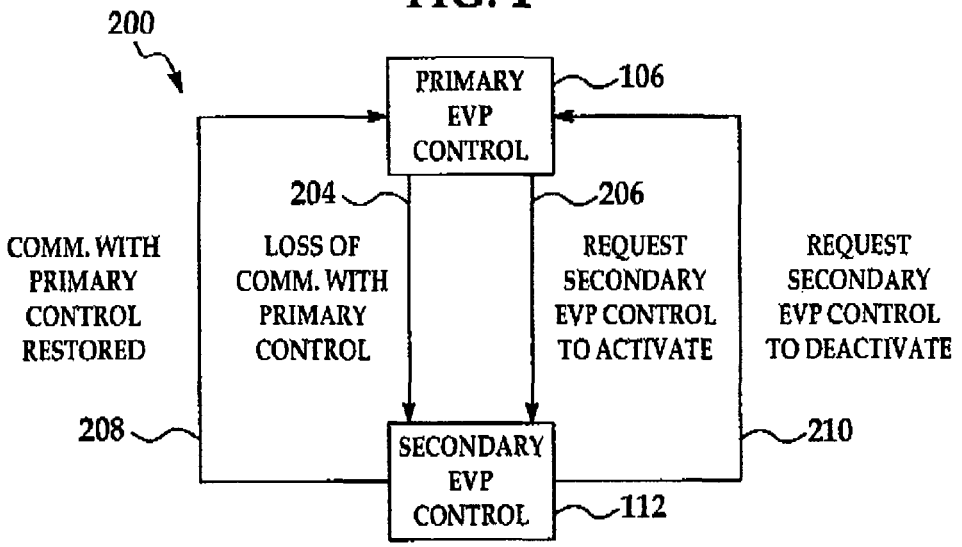
FIG. 2 is a flow diagram which illustrates transfer of vacuum pump operation between a primary EVP (electric vacuum pump) control and a secondary EVP control in implementation of an illustrative embodiment of the electric vacuum pump backup control system.

Referring next to FIG. 2, a flow diagram 200 which illustrates transfer of EVP operation between the primary EVP control 106 and the secondary EVP control 112 in implementation of the system 100 (FIG. 1) is shown. In some embodiments, the secondary EVP control 112 may be programmed to enter the vacuum pump control state for control of the electric vacuum pump 108 (FIG. 1) in the event that the secondary EVP control 112 loses communication with the primary EVP control 106 (arrow 204) and the primary EVP control 106 transmits a request for activation to the secondary EVP control 112 (arrow 206). The secondary EVP control 112 may be adapted to exit the vacuum pump control state and the primary EVP control 106 may be adapted to enter the vacuum pump control state in the event that communication between the secondary EVP control 112 and the primary EVP control 106 is restored (arrow 208) and the secondary EVP control 112 transmits a request for deactivation to the primary EVP control 106 (arrow 210).

Figure 3:
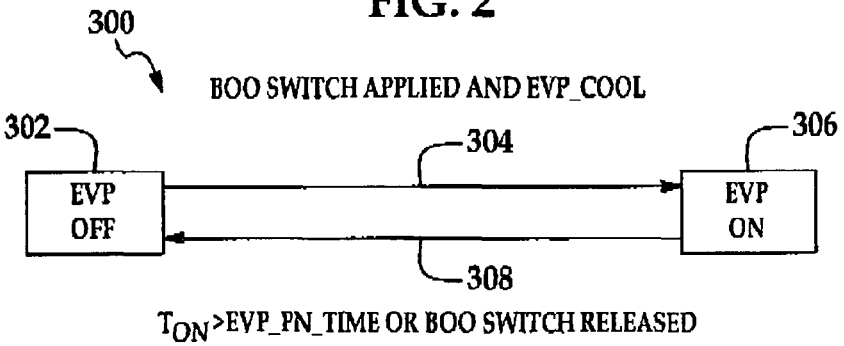
FIG. 3 is a flow diagram which illustrates switching of the secondary EVP control on and off in implementation of an illustrative embodiment of the electric vacuum pump backup control system.

Referring next to FIG. 3, a flow diagram 300 which illustrates switching of the secondary EVP control 112 (FIG. 1) on and off in implementation of an illustrative embodiment of the system 100 is shown. In block 302, the secondary EVP control 112 is off. In block 306, the secondary EVP control 112 is turned on by input from the BOO switch 104 (arrow 304). In some embodiments, the secondary EVP control 112 may be turned on only in the event that the primary EVP control 106 has been turned off for a minimum period of time (EVP_COOL). As indicated by the arrow 308, the secondary EVP control 112 may subsequently be turned off (block 302) in the event that the primary EVC control 106 resumes operation or the BOO switch 104 is released or opened.

Figure 4:
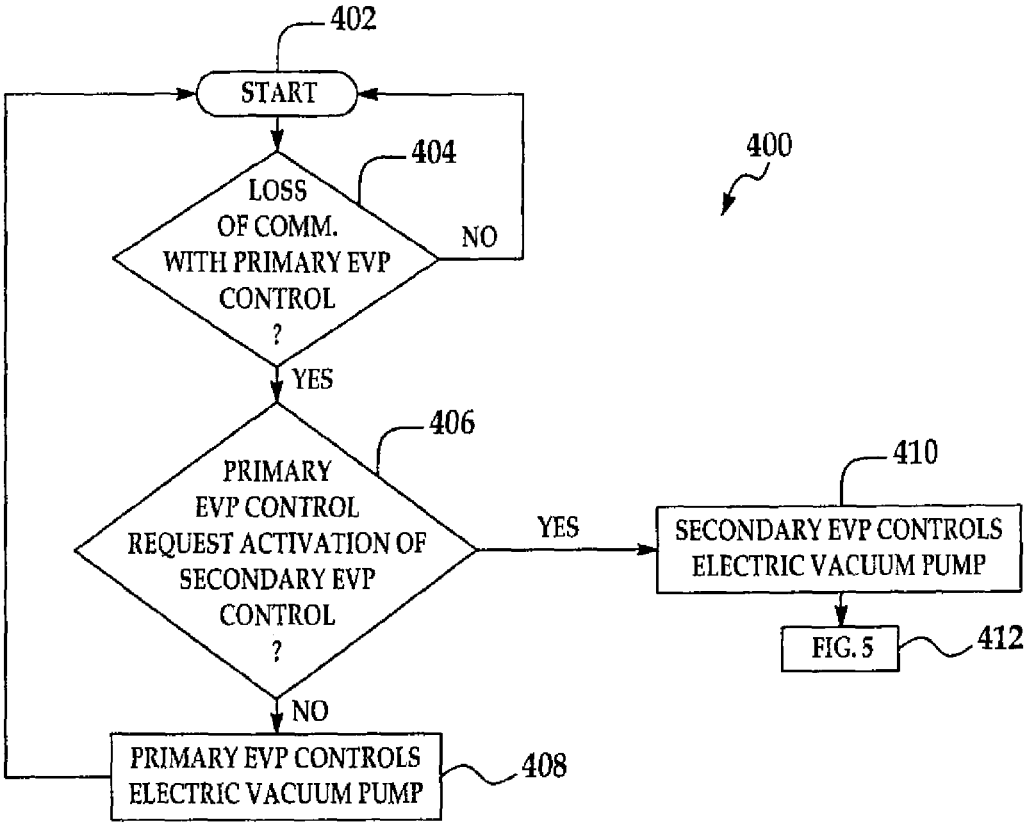
FIG. 4 is a flow diagram which illustrates a method which determines entry of the secondary EVP control into a vacuum pump control state according to an illustrative embodiment of the electric vacuum pump backup control method.

Referring next to FIG. 4, a flow diagram 400 which illustrates a method which determines entry of the secondary EVP control 112 into a vacuum pump control state according to an illustrative embodiment of the electric vacuum pump backup control method is shown. The method begins at block 402. In block 404, a determination may be made as to whether loss of communication between the primary EVP control 106 and the secondary EVP control 112 has occurred. If loss of communication between the primary EVP control 106 and the secondary EVP control 112 has not occurred, the method returns to block 402. If loss of communication between the primary EVP control 106 and the secondary EVP control 112 has occurred in block 404, a determination may be made as to whether the primary EVP control 106 has requested activation of the secondary EVP control 112 in block 406. If the primary EVP control 106 has not requested activation of the secondary EVP control 112 in block 406, the primary EVP control 106 may maintain control of the EVP 108 in block 408 and the method may return to block 402.

If the primary EVP control 106 has requested activation of the secondary EVP control 112 in block 406, the secondary EVP control 112 may enter the vacuum pump control state and control the EVP 108 in block 410. In block 412, the method may continue to the block diagram 500 in FIG. 5.

Figure 5:
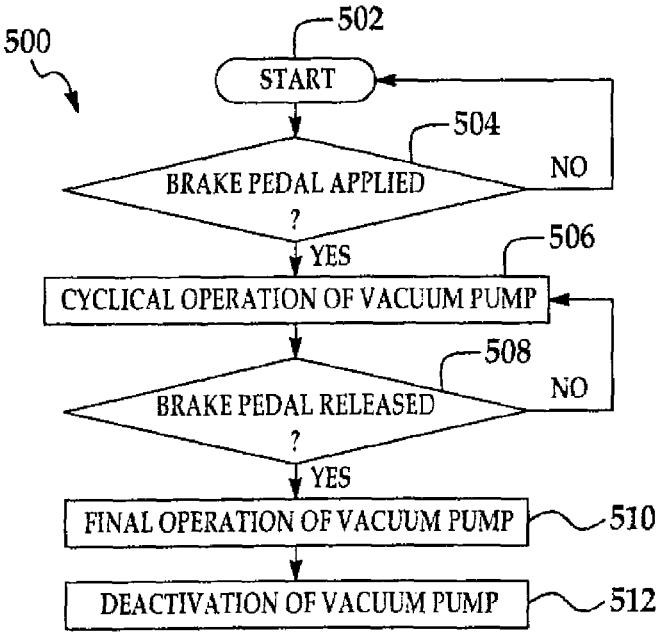
FIG. 5 is a flow diagram which illustrates operation of the secondary EVP control in the vacuum pump control state according to an illustrative embodiment of the electric vacuum pump backup control method.

Referring next to FIG. 5, a flow diagram 500 which illustrates operation of the secondary EVP control 112 in the vacuum pump control state according to an illustrative embodiment of the electric vacuum pump backup control method is shown. The method begins at block 502. In block 504, the BOO switch 104 (FIG. 1) of the system 100 may determine whether the vehicle brake pedal 102 (FIG. 1) has been applied. If the vehicle brake pedal 102 has not been applied, the method may return to block 502.

If the vehicle brake pedal 102 has been applied in block 504, the secondary EVP control 112, responsive to input from the BOO switch 104, may operate the EVP 108 in a cyclical manner in block 506. Accordingly, in some embodiments, the secondary EVP control 112 may operate the EVP 108 for about 100 ms, followed by deactivation of the EVP 108 for about 100 ms and operation of the EVP 108 again for about 100 ms in an alternating manner. The secondary EVP control 112 may continue the foregoing cyclical operational mode of the EVP 108 until the BOO switch 104 indicates that the vehicle brake pedal 102 has been released.

In block 508, the BOO switch 104 may determine whether the vehicle brake pedal 102 has been released. If the vehicle brake pedal 102 has not been released, the method may continue at block 506, at which the BOO switch 104 actuates cyclical operation of the EVP 108. If the vehicle brake pedal 102 has been released at block 508, the BOO switch 104 may actuate final operation of the EVP 108 in block 510. In some embodiments, the BOO switch 104 may actuate final operation of the EVP 108 for about 100 ms. In block 512, the BOO switch 104 may deactivate the EVP 108.

Figure 6:
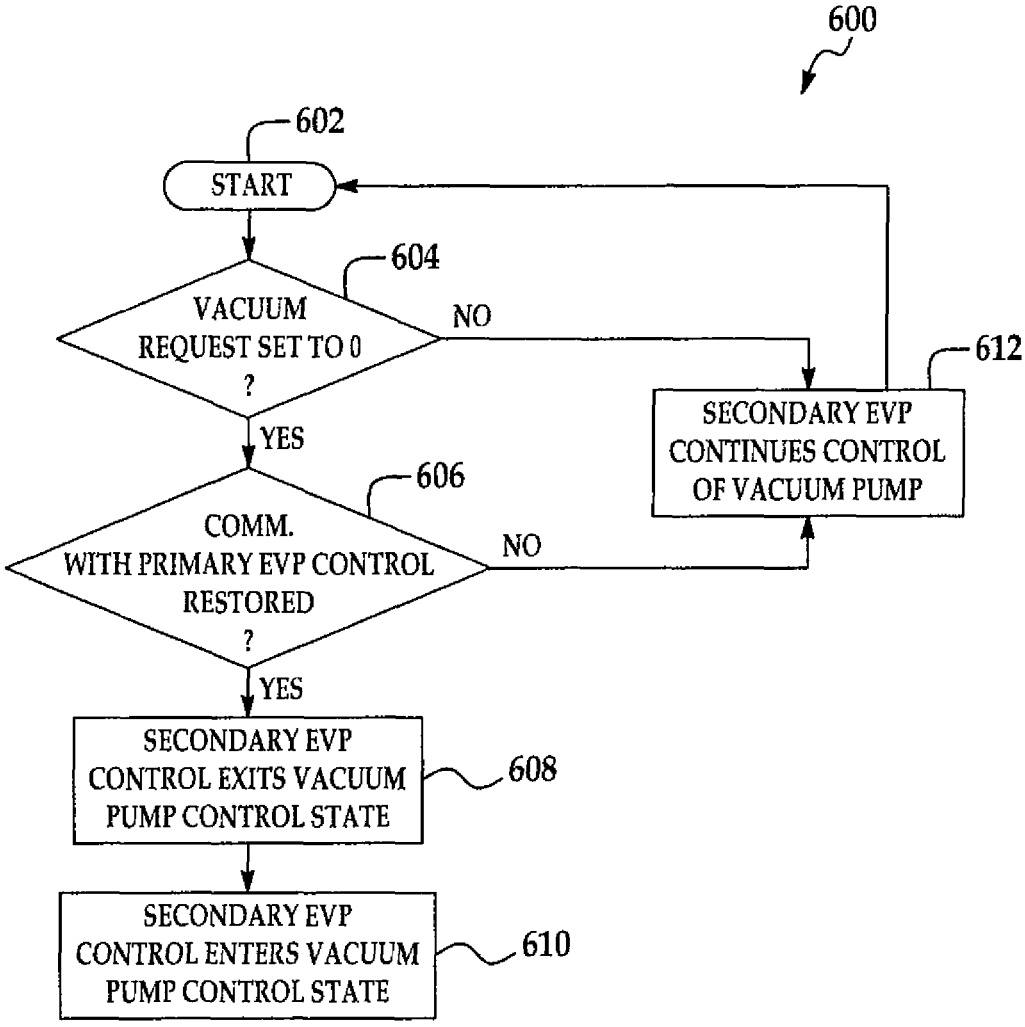
FIG. 6 is a flow diagram which illustrates a method which determines exiting of the secondary EVP control from the vacuum pump control state according to an illustrative embodiment of the electric vacuum pump backup control method.

Referring next to FIG. 6, a flow diagram 600 which illustrates a method which determines exiting of the secondary EVP control from the vacuum pump control state according to an illustrative embodiment of the electric vacuum pump backup control method is shown. The method may begin at block 602. In block 604, the secondary EVP control 112 may determine whether requests for activation are being received from the primary EVP control 106. If requests for activation are not being received from the primary EVP control 106, the secondary EVP control 112 may continue operation of the EVP 108 under input from the BOO switch 104. The method may return to block 602.

If requests for activation are being received from the primary EVP control 106 in block 604, the secondary EVP control 112 may determine whether communication with the primary EVP control 106 has been restored in block 606. If communication between the secondary EVP control 112 and the primary EVP control 106 has not been restored, the secondary EVP control 112 may continue control of the EVP 108 in block 612 and the method may return to block 602. If communication between the secondary EVP control 112 and the primary EVP control 106 has been restored, the secondary EVP control 112 may exit the vacuum pump control state in block 608 and the primary EVP control 106 may enter the vacuum pump control state in block 610.

Although the embodiments of this disclosure have been described with respect to certain exemplary embodiments, it is to be understood that the specific embodiments are for purposes of illustration and not limitation, as other variations will occur to those of skill in the art.

What is claimed is:

1. An electric vacuum pump backup control system, comprising:

a brake on/off switch;

a primary electric vacuum pump control interfacing with the brake on/off switch;

a secondary electric vacuum pump control separately interfacing with the brake on/off switch and the primary electric vacuum pump control;

an electric vacuum pump separately interfacing with the primary electric vacuum pump control and the secondary electric vacuum pump control; and wherein the brake on/off switch is configured to actuate the primary electric vacuum pump control, the primary electric vacuum pump control configured to operate the electric vacuum pump under normal braking operation, said brake on/off switch further configured to actuate the secondary electric vacuum pump control, the secondary electric vacuum pump control configured to operate the electric vacuum pump upon deactivation of the primary electric vacuum pump control and activation of the secondary electric vacuum pump control and further, said activation upon loss of communication between the primary electric vacuum pump control and secondary electric vacuum pump control, said primary and secondary electric vacuum pump controls configured to operate according to programmed instructions stored in controller readable non-transitory memory.

2. The system of claim 1 further comprising a vehicle brake pedal interfacing with the brake on/off switch.

3. The system of claim 1 further comprising vehicle brakes interfacing with the electric vacuum pump.

4. The system of claim 1 wherein the primary electric vacuum pump control comprises a vehicle Brake Control Module (BCM).

5. The system of claim 1 wherein the secondary electric vacuum pump control is configured to operate the electric vacuum pump responsive to said loss of communication with the primary electric vacuum pump control.

6. The system of claim 5 wherein the primary electric vacuum pump control is configured to resume operation of the electric vacuum pump responsive to restoration of communication between the primary electric vacuum pump control and the secondary electric vacuum pump control.

7. The system of claim 1 wherein the secondary electric vacuum control is configured to operate the electric vacuum pump responsive to receiving a request for activation from the primary electric vacuum pump control following said loss of communication between the primary electric vacuum pump control and the secondary electric vacuum pump control.

8. The system of claim 7 wherein the primary electric vacuum pump control is configured to resume operation of the electric vacuum pump responsive to receiving a request for deactivation from the secondary electric vacuum pump control following restoration of communication between the primary electric vacuum pump control and the secondary electric vacuum pump control.

9. An electric vacuum pump backup control system, comprising:

a vehicle brake pedal;

a brake on/off switch interfacing with the vehicle brake pedal;

a primary electric vacuum pump control interfacing with the brake on/off switch;

a secondary electric vacuum pump control separately interfacing with the brake on/off switch and the primary electric vacuum pump control;

an electric vacuum pump separately interfacing with the primary electric vacuum pump control and the secondary electric vacuum pump;

wherein the brake on/off switch is configured to actuate the primary electric vacuum pump control, the primary electric vacuum pump control configured to operate the electric vacuum pump under normal braking operation, said brake on/off switch further configured to actuate the secondary electric vacuum pump control, the secondary electric vacuum pump control configured to operate the electric vacuum pump upon deactivation of the primary electric vacuum pump control and activation of the secondary electric vacuum pump control;

wherein the secondary electric vacuum pump control is further configured to operate the electric vacuum pump responsive to loss of communication with the primary electric vacuum pump control and responsive to receiving a request for activation from the primary electric vacuum pump control following said loss of communication; and wherein the primary electric vacuum pump control is configured to resume operation of the electric vacuum pump responsive to restoration of communication between the primary electric vacuum pump control and the secondary electric vacuum pump control and responsive to receiving a request for deactivation from the secondary electric vacuum pump control following said restoration of communication, said primary and secondary electric vacuum pump controls configured to operate according to programmed instructions stored in controller readable non-transitory memory.

10. The system of claim 9 further comprising vehicle brakes interfacing with the electric vacuum pump.

11. The system of claim 9 wherein the primary electric vacuum pump control comprises a vehicle Brake Control Module (BCM).

12. An electric vacuum pump backup control method, comprising:

receiving input from a vehicle brake pedal;

operating an electric vacuum pump using a primary electric vacuum pump control in response, to input received by the primary electric vacuum pump control from the vehicle brake pedal under normal braking operation, said brake pedal input comprising actuating a brake on/off switch; and operating the electric vacuum pump using a secondary electric vacuum pump control in response to the input received by the secondary electric vacuum pump control from the vehicle brake pedal, said operating upon deactivation of the primary electric vacuum pump control and activation of the secondary electric vacuum pump control, said activation upon loss of communication between the primary electric vacuum pump control and secondary electric vacuum pump control, said primary and secondary electric vacuum pump controls operating ny executing programmed instructions.

13. The method of claim 12 further comprising resuming operation of the electric vacuum pump using the primary electric vacuum pump control upon restoring communication between the primary electric vacuum pump control and the secondary electric vacuum pump control.

14. The method of claim 12 wherein operating the electric vacuum pump using a secondary electric vacuum pump control comprises operating the electric vacuum pump using the secondary electric vacuum pump control responsive to the secondary electric vacuum pump control receiving a request for activation from the primary electric vacuum pump control.

15. The method of claim 14 further comprising resuming operation of the electric vacuum pump using the primary electric vacuum pump control responsive to the primary electric vacuum pump control receiving a request for deactivation from the secondary electric vacuum pump control.

16. The method of claim 12 wherein operating the electric vacuum pump using a secondary electric vacuum pump control comprises operating the electric vacuum pump using the secondary electric vacuum pump control responsive to loss of communication between the primary electric vacuum pump control and the secondary vacuum pump control and responsive to the secondary electric vacuum pump control receiving a request for activation from the primary electric vacuum pump control.

17. The method of claim 16 further comprising resuming operation of the electric vacuum pump using the primary electric vacuum pump control upon restoring communication between the primary electric vacuum pump control and the secondary electric vacuum pump control and responsive to the primary electric vacuum pump control receiving a request for deactivation from the secondary electric vacuum pump control.

* * * * *